US007088033B2

(12) United States Patent
Chandler et al.

(10) Patent No.: US 7,088,033 B2
(45) Date of Patent: Aug. 8, 2006

(54) ELECTRODELESS FLUORESCENT LAMP WITH STABILIZED OPERATION AT HIGH AND LOW AMBIENT TEMPERATURES

(75) Inventors: Robert T. Chandler, Lexington, MA (US); Oleg Popov, Needham, MA (US); Jakob Maya, Brookline, MA (US)

(73) Assignee: Matsushita Electric Works Ltd., Osaka (JP)

( * ) Notice: Subject to any disclaimer, the term of this patent is extended or adjusted under 35 U.S.C. 154(b) by 0 days.

(21) Appl. No.: 10/997,603

(22) Filed: Nov. 24, 2004

(65) Prior Publication Data

US 2006/0108945 A1 May 25, 2006

(51) Int. Cl.
*H01J 1/02* (2006.01)

(52) U.S. Cl. ..... 313/27; 313/47; 313/492; 313/493; 315/248

(58) Field of Classification Search ..... 313/27, 313/31, 46, 47, 161, 234, 490, 492, 493, 313/43; 315/248
See application file for complete search history.

(56) References Cited

U.S. PATENT DOCUMENTS

| | | | | |
|---|---|---|---|---|
| 5,952,784 | A * | 9/1999 | Witting | 313/634 |
| 6,081,070 | A | 6/2000 | Popov et al. | |
| 6,548,965 | B1 * | 4/2003 | Maya et al. | 315/249 |
| 6,555,954 | B1 * | 4/2003 | Chandler et al. | 313/485 |
| 6,605,889 | B1 * | 8/2003 | Anami et al. | 313/153 |
| 6,768,248 | B1 * | 7/2004 | Chandler et al. | 313/46 |
| 2002/0067129 | A1 | 6/2002 | Chamberlain et al. | |

FOREIGN PATENT DOCUMENTS

EP 1050897 A2 * 11/2000

* cited by examiner

*Primary Examiner*—Haissa Philogene
(74) *Attorney, Agent, or Firm*—Wolf, Greenfield & Sacks, P.C.

(57) ABSTRACT

An electrodeless lamp includes a bulbous lamp envelope enclosing an inert gas and a vaporizable metal fill, the lamp envelope having a reentrant cavity and an envelope bottom, an electromagnetic coupler positioned within the reentrant cavity, and a thermal shield positioned in proximity to the envelope bottom and configured to increase the temperature of the envelope bottom. By increasing the temperature of the envelope bottom, a cold spot is prevented. As a result, light output at low temperatures is comparable to light output at room temperature.

18 Claims, 4 Drawing Sheets

ELECTRODELESS FLUORESCENT LAMP WITH STABILIZED OPERATION AT HIGH AND LOW AMBIENT TEMPERATURES

FIELD OF THE INVENTION

This invention relates to electric lamps and, more particularly, to electrodeless fluorescent lamps which operate at frequencies from 25 kHz to 3.0 MHz and power levels in a range of 20 watts to 1000 watts.

BACKGROUND OF THE INVENTION

Electrodeless fluorescent lamps have recently been introduced into the market for indoor, outdoor, industrial and commercial applications. An advantage of electrodeless lamps is the absence of internal electrodes and heating filaments which are life-limiting factors in conventional fluorescent lamps. The life of electrodeless fluorescent lamps is substantially higher than that of conventional fluorescent lamps and can reach 100,000 hours.

A high power (50–500 watts) electrodeless fluorescent lamp operated at a frequency of 25–1000 kHz is disclosed in U.S. application Ser. No. 10/964,372, filed Oct. 13, 2004. A bulbous lamp envelope with a reentrant cavity is fabricated of glass and is filled with an inert gas (argon, krypton or xenon) and mercury vapor. An inductively coupled discharge is ignited and maintained in the lamp envelope by an azimuthal electric field induced in the envelope by a magnetic field. The magnetic field is generated by a high frequency current in an induction coil wrapped around a ferrite core which is positioned in the reentrant cavity.

An exhaust tubulation is sealed to the reentrant cavity on the cavity axis. A mercury amalgam is held in the tubulation by several glass pieces. The position of the amalgam is selected to keep the mercury vapor pressure in the lamp envelope near 6 mTorr (milliTorr) when the lamp is operated within an ambient temperature range of −20° C. to +70° C.

To remove heat from the ferrite core so as to keep its temperature below the Curie point, a cooling structure is utilized. The cooling structure includes a cooling tube of high thermal conductivity metal or ceramic positioned inside the ferrite core, and a heat sink of a high thermal conductivity material located at the bottom of the lamp envelope. The cooling tube and the heat sink are thermally and electrically connected.

A dielectric spacer is positioned between the ferrite core and the inner wall of the reentrant cavity to create a gap between the cavity wall and the ferrite core of 3–5 mm. The gap decreases heat transfer from the cavity wall to the ferrite core and the coil wire. Such an arrangement maintains the temperature of the ferrite core and the induction coil wire below 200° C. at a lamp power up to 300 watts.

However, when the lamp is operated in a base down position and an ambient temperature of −20° C. and lower, the temperature of the bottom of the lamp envelope can be substantially lower than the temperature of the amalgam in the exhaust tubulation. As a result, the envelope bottom operates as the cold spot and thereby controls mercury pressure in the lamp envelope. This leads to a decrease of mercury pressure in the lamp envelope below 6 mTorr and results in a substantial decrease of lamp light output.

Accordingly, there is a need for improved electrodeless fluorescent lamps which have light output at low ambient temperatures that is comparable to the light output at room temperature.

SUMMARY OF THE INVENTION

According to a first aspect of the invention, an electrodeless lamp is provided. The electrodeless lamp comprises a bulbous lamp envelope enclosing an inert gas and a vaporizable metal fill, the lamp envelope having a reentrant cavity and an envelope bottom, an electromagnetic coupler positioned within the reentrant cavity, and a thermal shield positioned in proximity to the envelope bottom and configured to increase the temperature of the envelope bottom.

According to a second aspect of the invention, an electrodeless lamp is provided. The electrodeless lamp comprises a bulbous lamp envelope enclosing an inert gas and a vaporizable metal fill, the lamp envelope having a reentrant cavity, an electromagnetic coupler positioned within the reentrant cavity, and a thermal shield positioned in proximity to a potential cold spot of the lamp envelope and configured to increase the temperature of the potential cold spot.

According to a third aspect of the invention, a method is provided for enhancing performance of an electrodeless lamp including a bulbous lamp envelope having a reentrant cavity and an envelope bottom, and an electromagnetic coupler positioned within the reentrant cavity. The method comprises thermally shielding the envelope bottom from the ambient environment.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
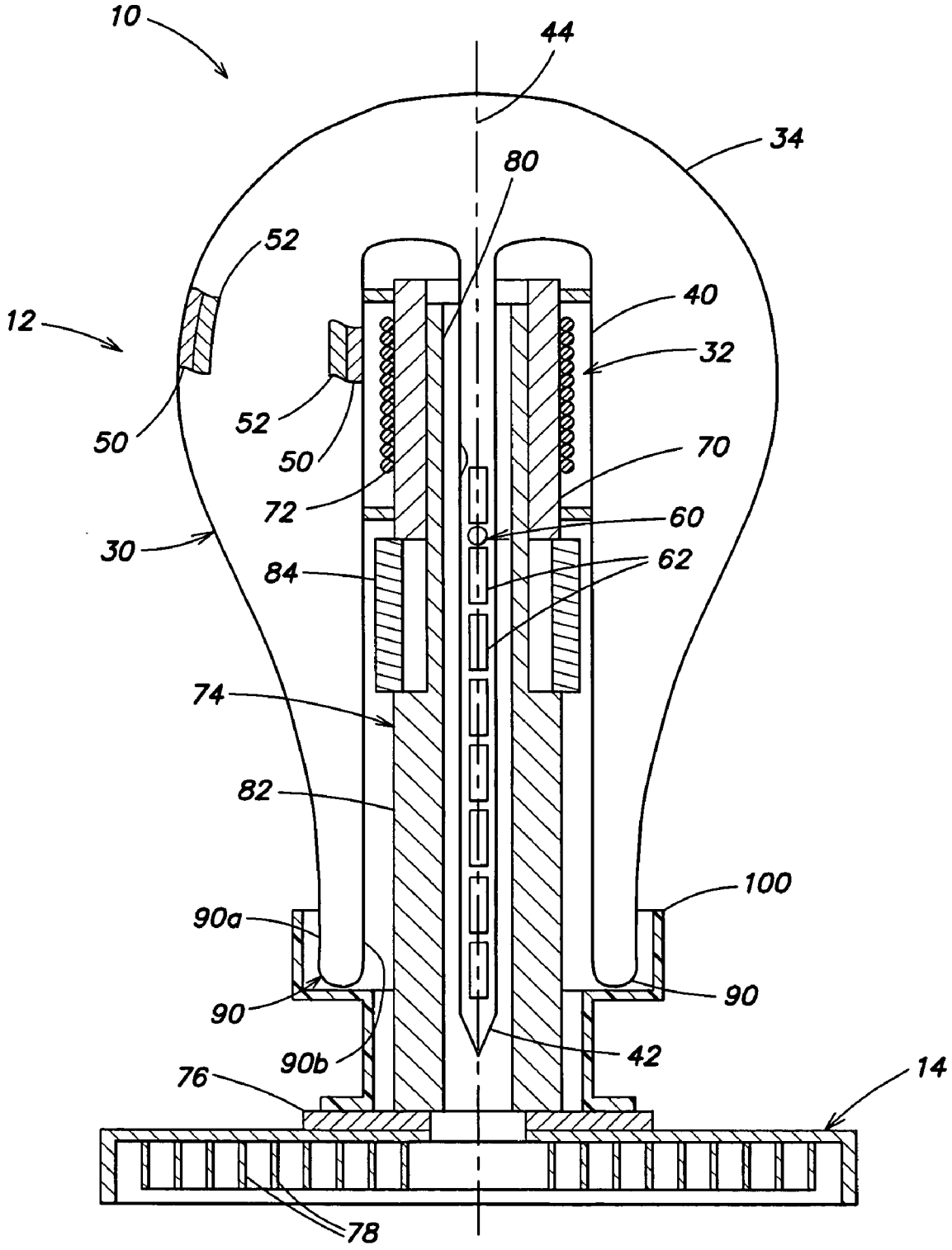
FIG. 1 is a schematic cross-sectional view of a lamp assembly, including an electrodeless fluorescent lamp and a base fixture, in accordance with an embodiment of the invention.

A simplified cross-sectional diagram of a lamp assembly in accordance with an embodiment of the invention is shown in FIG. 1. A lamp assembly 10 includes an electrodeless lamp 12 and a base fixture 14 for supporting the lamp 12 and serving as a heat sink. Electrodeless lamp 12 includes a lamp envelope 30 and an electromagnetic coupler 32.

Lamp envelope 30 may be made from glass and may have a bulbous shape, as shown in FIG. 1. Lamp envelope 30 includes a bulbous outer envelope 34 and a reentrant cavity 40 on a cavity axis 44. Reentrant cavity 40 may have a generally cylindrical shape. The outer diameter of lamp envelope 30 may be in a range of 50 mm (millimeters) to 300 mm and in a preferred embodiment is 180 mm. The inner diameter of reentrant cavity 40 may be in a range of 20 mm to 100 mm and in a preferred embodiment is 42 mm. The height of lamp envelope 30 may be in a range of 50 mm to 500 mm and in a preferred embodiment is 250 mm.

An inert fill gas, such as argon, krypton, xenon, or the like, may have a pressure in a range of 0.001 Torr to 5 Torr in lamp envelope 30. In a preferred embodiment, argon is utilized at a pressure in a range of 10 mTorr to 500 mTorr. The inside wall of lamp envelope 30 and reentrant cavity 40 are coated with a protective coating 50 and a phosphor coating 52.

A mercury amalgam 60 is positioned in an exhaust tubulation 42 and controls the mercury vapor pressure in the lamp envelope 30. Several glass pieces 62 hold the amalgam 60 in a fixed position that is selected to keep the amalgam temperature within a range that provides a mercury vapor pressure in lamp envelope 30 of about 6 mTorr within a wide range of ambient temperatures, from −20° C. to +70° C.

Electromagnetic coupler 32 is located in reentrant cavity 40 and includes a magnetic core 70, an induction coil 72 and a cooling structure 74. The coupler 32 is connected thermally and electrically to base fixture 14 via a lamp base 76. Base fixture 14 may include fins 78 that dissipate heat conducted to base fixture 14 by coupler 32.

The induction coil 72 may be made from multiple strand wire, such as Litz wire, wound around magnetic core 70. The number of strands may be in a range of 7 to 470. The number of coil turns may be in a range of 10 to 100. In a preferred embodiment, the number of strands is 19 and the number of turns is 32. The magnetic core 70 may be made from a ferrite material, such as MnZn or the like, that has very low power losses at frequencies of 20 kHz to 400 kHz, and has good thermal contact with the cooling structure 74. Additional details of the ferrite core are provided in published U.S. Application No. 2002/0067129 A1, which is hereby incorporated by reference. The outer diameter of core 70 may be in a range of 8 mm to 100 mm and the inner diameter of core 70 may be in a range of 3 mm to 50 mm. In a preferred embodiment, the outer diameter of magnetic core 70 is 32 mm and the inner diameter is 16.5 mm. The length of magnetic core 70 may be in a range of 20 mm to 300 mm and in a preferred embodiment is 100 mm. The magnetic core 70 and induction coil 72 are positioned along cavity axis 44 so the center of core 70 is approximately positioned where the diameter of lamp envelope 30 is maximum. Such a location of core 70 and coil 72 provides a low plasma electric field and hence a low magnetic field and low core power losses.

Cooling structure 74 may include a cooling tube 80, an extension tube 82 and a coil spacer 84. The cooling tube 80 is made of a material having high thermal conductivity, such as Cu, Al, $Al_2O_3$, BN, or the like, and is disposed along cavity axis 44. In a preferred embodiment, cooling tube 80 is made of copper. The inner diameter of cooling tube 80 is larger than the outer diameter of exhaust tubulation 42, and the outer diameter of cooling tube 80 is smaller than the inner diameter of magnetic core 70. In a preferred embodiment, the inner diameter of cooling tube 80 is 9 mm and the outer diameter is 16 mm. The cooling tube 80 is thermally connected to extension tube 82. In a preferred embodiment, cooling tube 80 and extension tube 82 are made as one piece, as shown in FIG. 1.

Lamp envelope 30 has a generally cylindrical envelope bottom 90 that is formed by the sealed ends of outer envelope 34 and reentrant cavity 40. More specifically, envelope bottom 90 is defined by a generally cylindrical outer sidewall 90*a*, which is part of outer envelope 34, and a generally cylindrical inner sidewall 90*b*, which is part of reentrant cavity 40. Sidewalls 90*a* and 90*b* are sealed together at the bottom end of lamp envelope 30. The envelope bottom 90 is positioned in proximity to a thermal shield 100 that has an inner diameter slightly larger than the outer diameter of envelope bottom 90. The inner diameter of envelope bottom 90 is larger than the outer diameter of magnetic core 70 and may be in a range of 11 mm to 100 mm. The outer diameter of the envelope bottom 90 may be in a range of 15 mm to 200 mm. In a preferred embodiment, the inner diameter of envelope bottom 90 is 42 mm and the outer diameter is 60 mm.

The thermal shield 100 encloses the outside of envelope bottom 90 and is disposed on lamp base 76, which is thermally and electrically connected to base fixture 14 as shown in FIG. 1. Thermal shield 100 reduces heat transfer via convection from envelope bottom 90 to the ambient environment, thereby increasing the temperature of envelope bottom 90 and preventing the formation of a cold spot on the vacuum side of the envelope bottom walls. As a result, the mercury pressure in lamp envelope 30 is controlled only by the temperature of mercury amalgam 60.

In a preferred embodiment, the spacing between the sidewall of envelope bottom 90 and the inner surface of thermal shield 100 is 2.0 mm. The spacing between the end of envelope bottom 90 and thermal shield 100 is preferably about 1 mm.

Figure 2A:
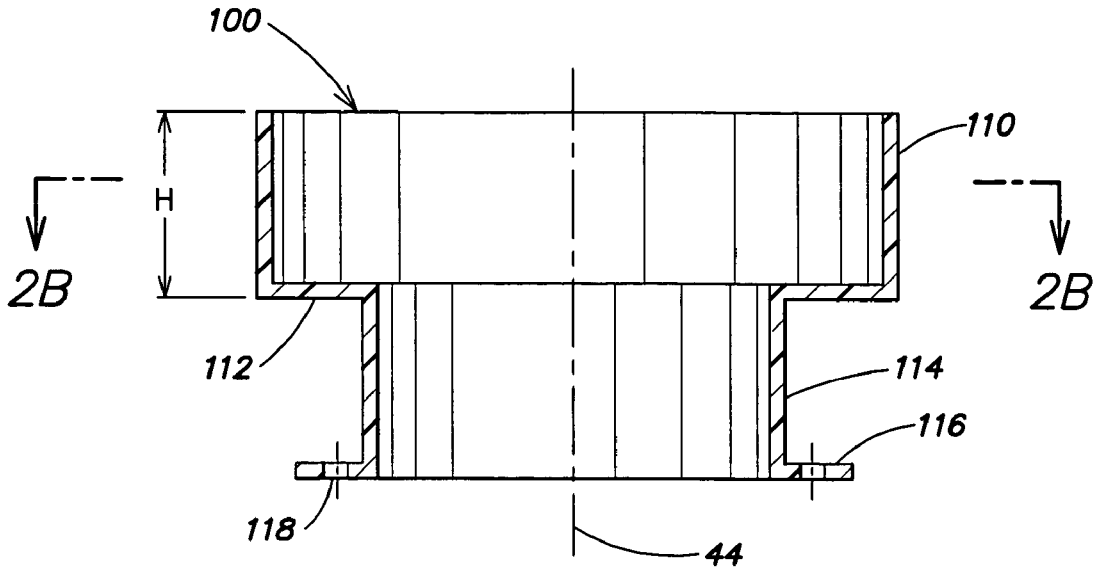
FIG. 2A is a cross-sectional view of a thermal shield in accordance with an embodiment of the invention.
Figure 2B:
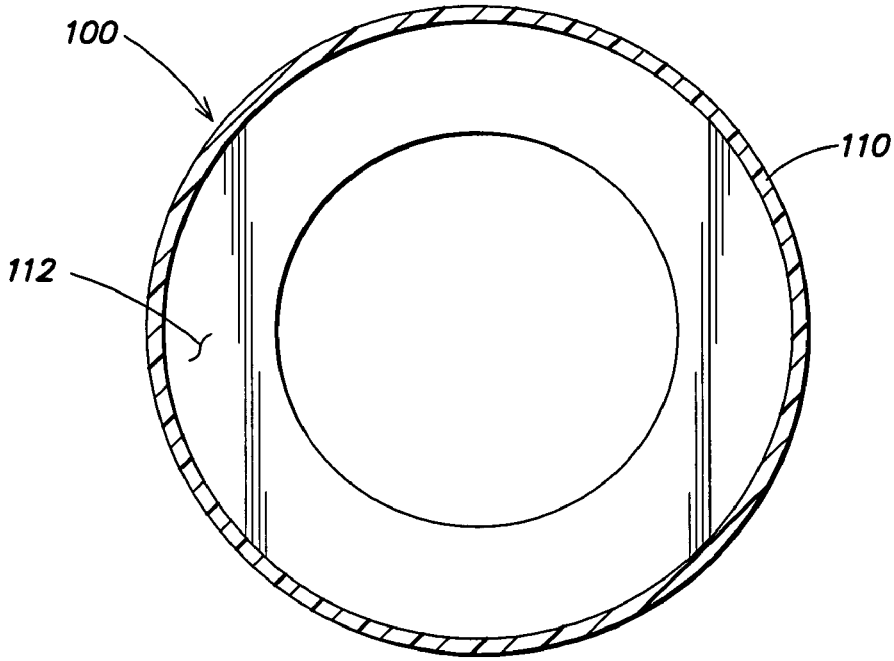
FIG. 2B is a top view of the thermal shield of FIG. 2A.

A cross-section of thermal shield 100 is shown in FIG. 2A. A cross-section of thermal shield 100 along the line 2B–2B of FIG. 2A is shown in FIG. 2B. Thermal shield 100 includes a cylindrical external shield 110, a support 112, a cylindrical shield holder 114 and a connecting flange 116. External shield 110 encloses envelope bottom 90, and flange 116 is physically connected to lamp base 76 using holes 118. In a preferred embodiment, thermal shield 100 is made as a single piece from a material having low thermal conductivity, such as plastic, polyvinyl chloride (PVC), or the like.

The inner diameter of external shield 110 is larger than the outer diameter of envelope bottom 90 and may be in a range of 16 mm to 220 mm. In a preferred embodiment, the inner diameter of external shield 110 is 65 mm. The thickness of external shield 110 may be in a range of 1 mm to 10 mm, and the height H of external shield 110 may be in a range of 2 mm to 200 mm. It will be understood that the height H of external shield 110 may be selected to enclose more or less of envelope bottom 90 to achieve a desired temperature during operation. In a preferred embodiment, the thickness of external shield 110 is 2 mm and the height is 30 mm. The thickness of support 112 may be in a range of 1 mm to 10 mm. In a preferred embodiment, the thickness of support 112 is 2 mm.

The inner diameter of shield holder 114 is slightly larger than the outer diameter of magnetic core 70 and is slightly smaller than the inner diameter of envelope bottom 90. In a preferred embodiment, the inner diameter of shield holder 114 is 40 mm. The thickness of shield holder 114 may be in a range of 1 mm to 10 mm. In a preferred embodiment, the thickness of shield holder 114 is 2 mm. The height of shield holder 114 may be in a range of 10 mm to 200 mm. In a preferred embodiment, the height of shield holder 114 is 50 mm. The inner diameter of flange 116 is determined by the inner diameter of shield holder 114, and in a preferred embodiment is 40 mm. The outer diameter of flange 116 may be in a range of 12 mm to 200 mm. In a preferred embodiment, the outer diameter of flange 116 is 65 mm.

Figure 3A:
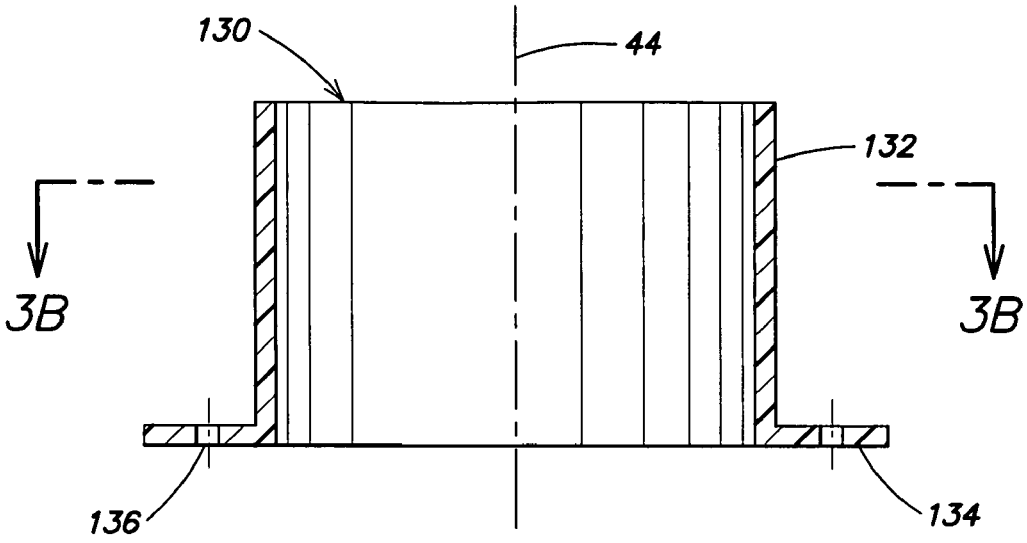
FIG. 3A is a cross-sectional view of a thermal shield in accordance with another embodiment of the invention.
Figure 3B:
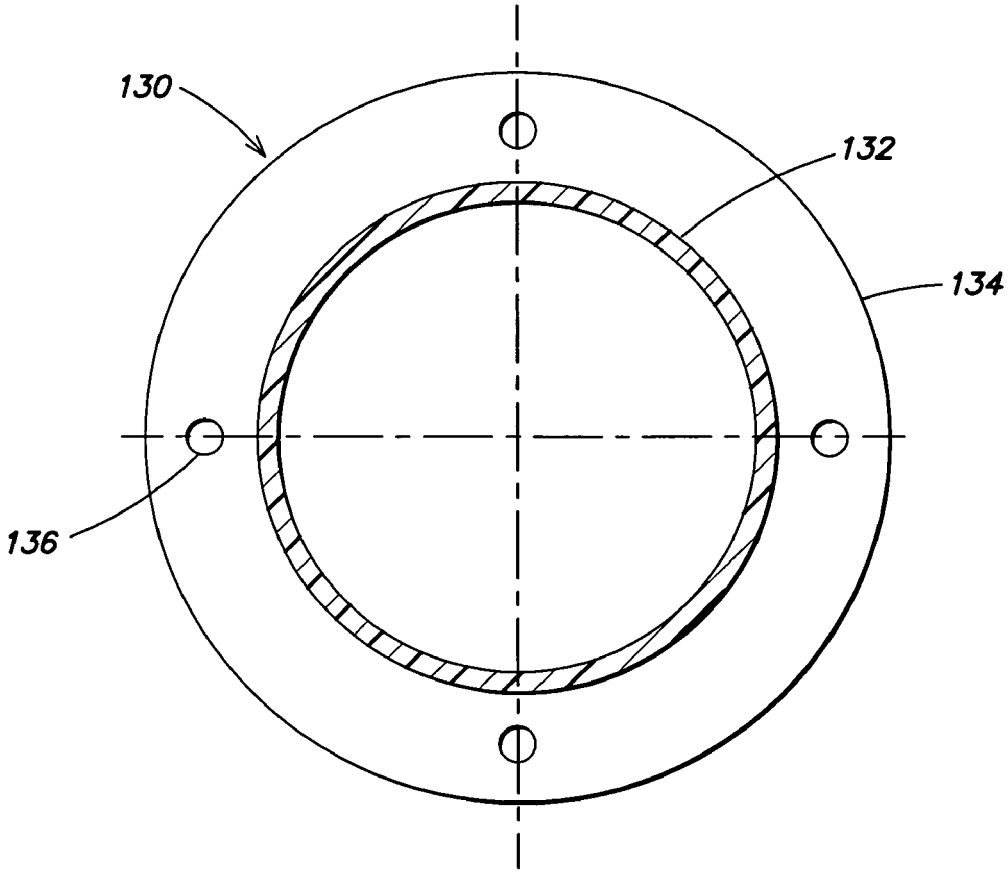
FIG. 3B is a top view of the thermal shield of FIG. 3A.

A second embodiment of the thermal shield is shown in FIGS. 3A and 3B. A thermal shield 130 includes a thermal cylinder 132 and a connecting flange 134. Thermal shield 130 is made of a low thermal conductivity material, such as plastic, PVC, or the like. In a preferred embodiment, thermal shield 130 is made as a single piece. The inner diameter of thermal cylinder 132 may be in a range of 16 mm to 220 mm. The height of thermal cylinder 132 may be in a range of 10 mm to 200 mm, and the thickness of thermal cylinder 132 may be in a range of 1 mm to 10 mm. In a preferred embodiment, the inner diameter of thermal cylinder 132 is 65 mm, the height is 15 mm and the thickness is 2 mm.

The inner diameter of connecting flange 134 is determined by the inner diameter of thermal cylinder 132. In a preferred embodiment, the inner diameter of connecting flange 134 is 65 mm. The outer diameter of connecting flange 134 may be in a range of 20 mm to 200 mm. In a preferred embodiment, the outer diameter of connecting flange 134 is 75 mm. Connecting flange 134 is attached to lamp base 76 using holes 136.

The lamp is operated as follows. A high frequency voltage in a frequency range of 20 kHz to 3.0 MHz is applied to induction coil 72 and generates in coil 72 a high frequency current. The current in turn generates a magnetic field in lamp envelope 30 that induces an azimuthal electric field in the lamp envelope. By increasing the applied voltage, the electric field in lamp envelope 30 reaches its starting value which causes a bright, inductively-coupled plasma in lamp envelope 30.

The plasma generates ultraviolet radiation which causes emission of visible radiation from the phosphor coating 52 on the walls of outer envelope 34 and reentrant cavity 40. The total visible light output depends on the amount of high frequency power absorbed by the plasma and on the mercury vapor pressure. The mercury vapor pressure is controlled by the temperature of the mercury amalgam 60. The mercury amalgam 60 is located in exhaust tubulation 42 in a fixed position so as to maintain the temperature of amalgam 60 within the temperature range that provides mercury pressure in lamp envelope 30 of about 6 mTorr, which is optimum for the generation of maximum visible light output.

The walls of envelope bottom 90 are not subjected to plasma heating and therefore may have a temperature that is sufficiently low to form a cold spot. The resulting mercury vapor pressure is controlled by both the cold spot temperature and by the amalgam temperature, which leads to light output instability. A further decrease of the temperature of the walls of envelope bottom 90 results in a decrease of mercury vapor pressure and hence to a decrease in the total light output.

By thermally insulating the area of a possible cold spot from the ambient atmosphere, the temperature of this area can be increased during lamp operation, thereby preventing the formation of the cold spot. This is especially important for operation at low ambient temperatures where the cold spot temperature could cause a drop of mercury pressure to values well below 6 mTorr. When the electrodeless lamp is operated in a base down position at ambient temperatures below 0° C., a cold spot may be formed on the walls of envelope bottom 90. The temperature of the walls of envelope bottom 90 is the lowest temperature on lamp envelope 30, since there is no plasma in this area that interacts with and heats the walls of envelope bottom 90.

Thermal shield 100 encloses envelope bottom 90 from below and outside, thereby reducing thermal contact between envelope bottom 90 and the ambient atmosphere. Thermal shield 100 thus causes an increase of the temperature of the walls of envelope bottom 90 to a value that corresponds to a mercury vapor pressure higher than the pressure corresponding to the amalgam temperature. As a result, a cold spot is not formed on the walls of envelope bottom 90 and the mercury vapor pressure in lamp envelope 30 is controlled by the temperature of mercury amalgam 60 only.

Figure 4:
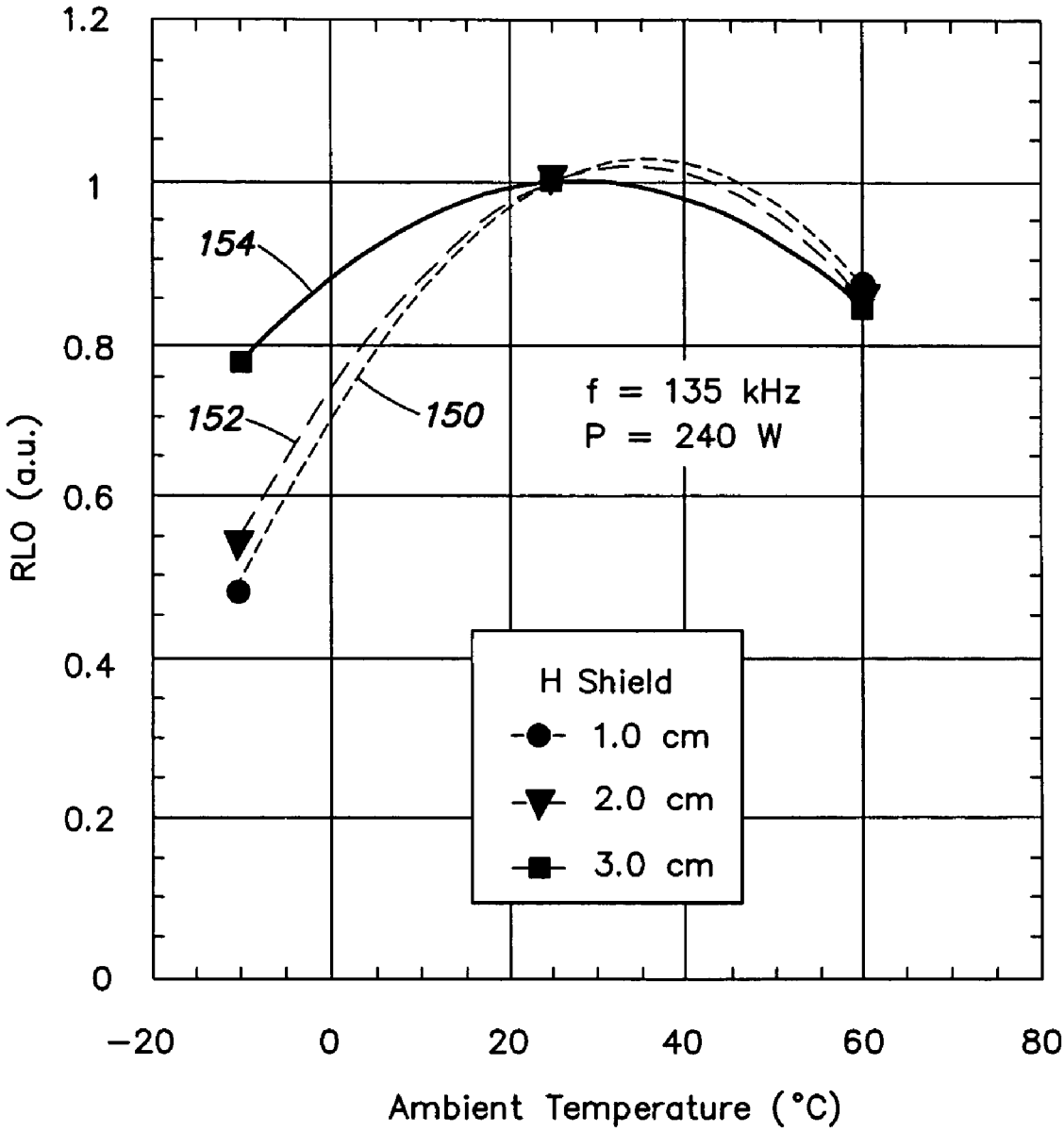
FIG. 4 is a graph of stabilized relative light output (RLO) as a function of ambient temperature for an electrodeless lamp operating at a frequency of 135 kHz and a lamp power of 240 watts for different heights (H) of a thermal shield.

The effect of thermal shield 100 is illustrated in FIG. 4, where relative light output (RLO) is plotted as a function of ambient temperature. Thermal shields having external shield 110 height H of 1 cm, 2 cm and 3 cm were used, as represented by curves 150, 152 and 154, respectively. The lamp power was 240 watts and the driving frequency was 135 kHz. When operating at an ambient temperature of −10° C., the relative light output varies as a function of the height H of external shield 110. When a 1 cm high shield is used, relative light output is very small (0.47). An increase of shield height to 3 cm results in an increase of relative light output to 0.77.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An electrodeless lamp comprising:

a bulbous lamp envelope enclosing an inert gas and a vaporizable metal fill, the lamp envelope having a reentrant cavity and an envelope bottom;

an electromagnetic coupler positioned within said reentrant cavity; and a thermal shield positioned in proximity to the envelope bottom and configured to increase the temperature of the envelope bottom.

2. An electrodeless lamp as defined in claim 1, wherein the thermal shield surrounds the envelope bottom.

3. An electrodeless lamp as defined in claim 1, wherein the thermal shield includes a low thermal conductivity material.

4. An electrodeless lamp as defined in claim 1, wherein the thermal shield is configured to thermally shield the envelope bottom from the ambient environment.

5. An electrodeless lamp as defined in claim 1, wherein the thermal shield includes a cylindrical external shield surrounding the envelope bottom, a support configured to support the external shield, and a shield holder.

6. An electrodeless lamp as defined in claim 5, wherein the shield holder includes a cylindrical portion of smaller diameter than the external shield, the thermal shield further including a connecting flange.

7. An electrodeless lamp as defined in claim 5, wherein the external shield has a height of 5 to 100 millimeters.

8. An electrodeless lamp as defined in claim 1, wherein the thermal shield includes a cylindrical portion of uniform diameter and a connecting flange.

9. An electrodeless lamp as defined in claim 1, further comprising a lamp base, wherein the thermal shield is secured to the lamp base.

10. An electrodeless lamp as defined in claim 1, wherein the thermal shield comprises a plastic material.

11. An electrodeless lamp as defined in claim 1, wherein the thermal shield is configured as a single piece.

12. An electrodeless lamp as defined in claim 1, wherein the thermal shield includes a cylindrical sidewall that is spaced from the envelope bottom.

13. An electrodeless lamp as defined in claim 1, wherein the thermal shield is positioned in proximity to a potential cold spot of the lamp envelope.

14. An electrodeless lamp as defined in claim 1, wherein the thermal shield is spaced from the envelope bottom by about 1 to 2 millimeters.

15. An electrodeless lamp comprising:

a bulbous lamp envelope enclosing an inert gas and a vaporizable metal fill, the lamp envelope having a reentrant cavity;

an electromagnetic coupler positioned within said reentrant cavity; and a thermal shield positioned in proximity to a potential cold spot and configured to increase the temperature of the potential cold spot.

16. An electrodeless lamp as defined in claim 15, wherein the thermal shield is positioned in proximity to an envelope bottom of the lamp envelope.

17. An electrodeless lamp as defined in claim 16, wherein the thermal shield includes a cylindrical portion that surrounds the envelope bottom and wherein the thermal shield is secured to a lamp base.

18. In an electrodeless lamp including a bulbous lamp envelope having a reentrant cavity and an envelope bottom, and an electromagnetic coupler positioned within the reentrant cavity, a method for enhancing performance comprising:

thermally shielding the envelope bottom from the ambient environment, the step of thermally shielding comprising increasing the temperature of the envelope bottom.

* * * * *